United States Patent [19]

Buehl

[11] 4,200,085

[45] Apr. 29, 1980

[54] DOLLY-TYPE HEATING DEVICE WITH HEATER SECTION ADJUSTABILITY

[75] Inventor: Arnold L. Buehl, Solon, Ohio

[73] Assignee: Econoray Inc., Solon, Ohio

[21] Appl. No.: 920,488

[22] Filed: Jun. 29, 1978

[51] Int. Cl.[2] ..... F24C 1/16

[52] U.S. Cl. ..... 126/9 B; 126/349

[58] Field of Search ..... 126/9 R, 9 B, 91, 349

[56] References Cited

U.S. PATENT DOCUMENTS

| | | | |
|---|---|---|---|
| 98,244 | 12/1869 | Gibson, Jr. | 126/349 |
| 766,442 | 8/1904 | Gruener | 126/349 |
| 2,732,487 | 2/1956 | Crider | 362/410 |
| 2,768,042 | 10/1956 | Presinger et al. | 126/9 B |
| 2,774,345 | 12/1956 | Peplin | 126/9 B |
| 2,916,292 | 12/1959 | Olson | 280/47.13 |
| 2,950,925 | 8/1960 | Larson | 280/47.19 |
| 3,147,748 | 9/1964 | Frank | 126/9 |
| 3,223,826 | 12/1965 | Macaluso | 219/352 |
| 3,263,061 | 7/1966 | Rawald et al. | 219/343 |
| 3,297,016 | 1/1967 | Rhodes | 126/9 R |
| 3,837,539 | 9/1974 | Schlegel | 222/609 |

*Primary Examiner*—Albert W. Davis
*Assistant Examiner*—Wesley S. Ratliff, Jr.
*Attorney, Agent, or Firm*—Portz & Portz

[57] ABSTRACT

A heating device comprising, as portions, a heater and a dolly of which a tilt frame of the dolly is attached to, or fixed integrally with, the housing of the heater with such adjustability with respect to a base of the dolly to afford universality of position of the heater when taking into account the orientability of the device as a whole. The scope of positioning of the device is greatly amplified by use of a handle strut fixed to the tilt frame.

10 Claims, 9 Drawing Figures

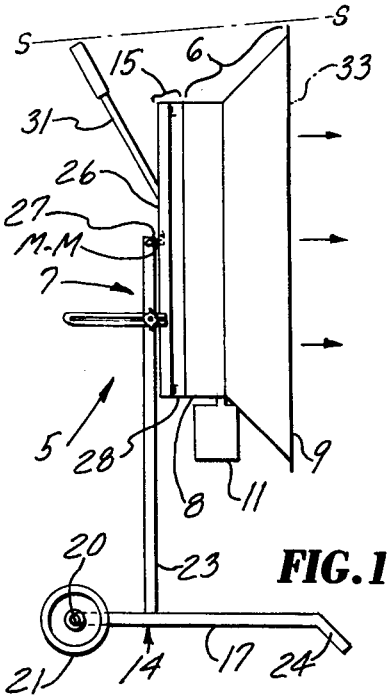
FIG. 1
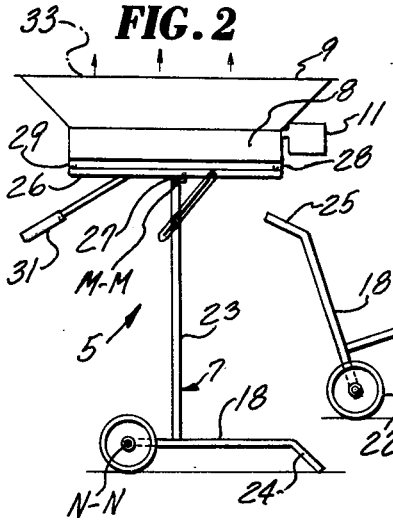
FIG. 2
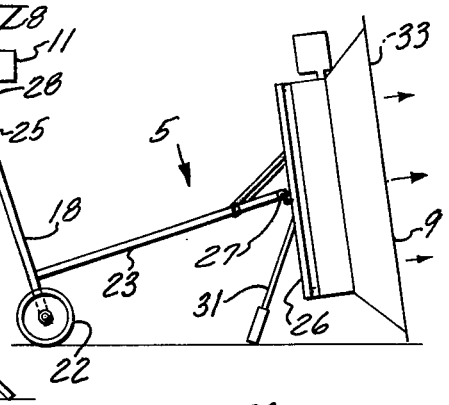
FIG. 3
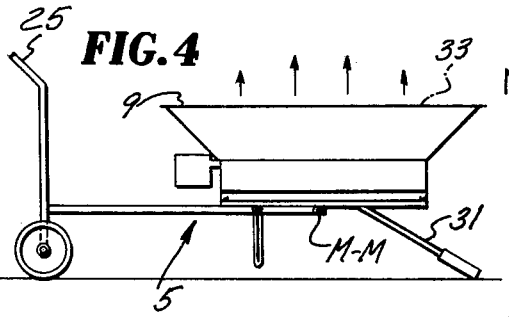
FIG. 4
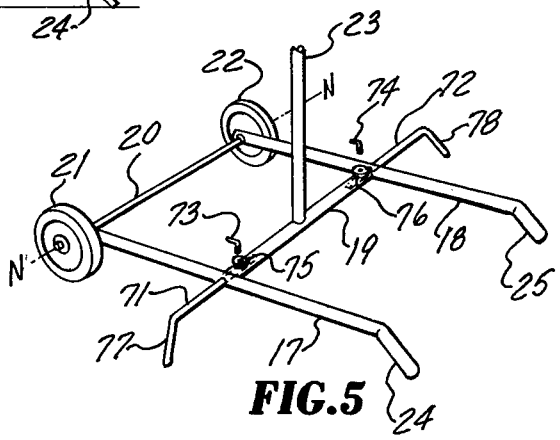
FIG. 5
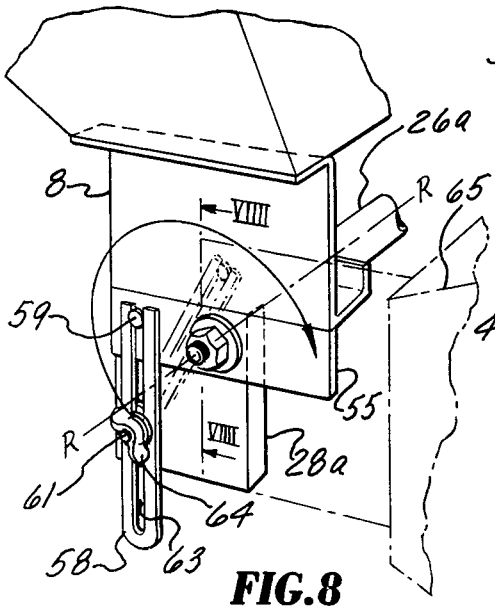
FIG. 8
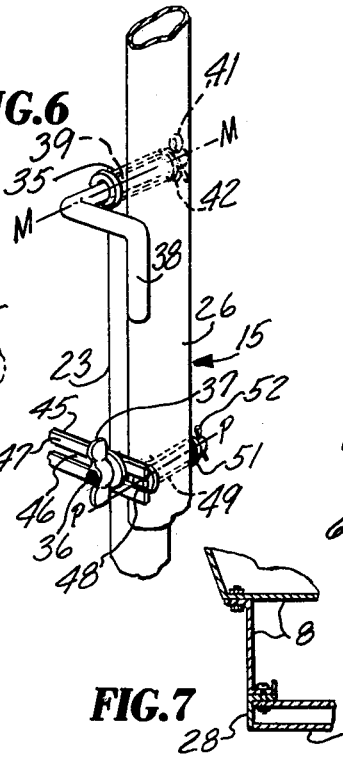
FIG. 6
FIG. 7
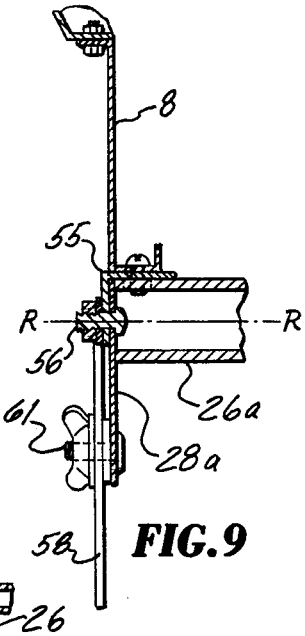
FIG. 9

DOLLY-TYPE HEATING DEVICE WITH HEATER SECTION ADJUSTABILITY

BACKGROUND OF THE INVENTION

This invention is directed to portable heating equipment capable of directing energies of 1,000 to 20,000 watts or more in a path of predetermined configuration for such purposes as baking paint; curing thermosetting materials; rendering temporary comfort to outside or inside personnel areas exposed to severely cold temperatures; thawing out frozen equipment; or preheating aircraft, automotive, or other engines. For such uses, it is important and desirable to provide a dolly-type heating device capable of all manner of positions in respect to a support plane in order that the radiated energy may be most effectively applied.

Hence, it is a primary object of this invention to provide a dolly-type heater device of articulated construction and with such structural features as to afford a great range of adjustments of the heat radiating section relative to the base of the dolly, and further, to enable the device as a whole to assume a plurality of positions relative to a floor or other support surface.

It is a more specific object to provide a dolly-type heating device especially adapted for the radiation of heat energy from an elongate heater housing such as utilized in the construction of infra-red heating units.

SUMMARY OF THE INVENTION

The present invention achieves the above-mentioned and other objects in a manner not known to the inventor from the prior art in the provision of a dolly-type heating device comprising, as main components, a heater having an elongate housing provided with an open side for radiation, a dolly having a base and a tilt frame in pivotal relation with an upper portion of an upstanding mast of the base. The tilt frame directly supports the heater and thus renders it tiltable through a preselected angle relative to the base and securable to different positions by a releasable detent mechanism such as a link and clamp-screw connection between the mast and the tilt frame.

The geometry of the base, especially that of the mast and the tilt frame, and a strut handle attached to that portion of the tilt frame ordinarily in a radially outward position with its pivotal connection with the mast, is such as to enable tilting of the device as a whole about a tilting axis, e.g., through a pair of dolly wheels, to engage the strut handle with a supporting surface for the device. In this manner, the device utilizes alternate floor-engaging members in combination with other continuously floor engaging means such as coaxial dolly wheels.

DESCRIPTION OF THE DRAWING

FIG. 1 is a side view of a dolly-type heating device according to this invention as oriented in a normal upright position for radiating energy substantially horizontally in the direction of the arrows.

FIG. 2 is a side view of the device of FIG. 1 with the base positioned as shown in FIG. 1 but the heater and tilt frame thereof adjusted for directing radiation in an upwardly vertical direction.

FIG. 3 is a side view of the device of FIGS. 1 and 2 showing the device as adjusted in FIG. 2 tilted about the axis of its dolly wheels to allow a portion of its weight to be supported on a portion of the tilt frame, i.e., a handle strut.

FIG. 4 is a side view of the device of FIGS. 1, 2, and 3 illustrating the use of the handle strut as a floor-engaging means when the device is in a "prone" position for directing radiation vertically upward.

FIG. 5 is a fragmentary perspective view of a modified base for the device of the invention illustrating lateral floor-engaging supports which are adjustable with respect to the main portion of the base.

FIG. 6 is a fragmentary perspective elevation of portions of the mast of the base, the tilt frame, and the pivotal connection thereof.

FIG. 7 is a fragmentary cross section in elevation of portions of the tilt frame and heater housing of the embodiment of FIGS. 1 to 4.

FIG. 8 is a fragmentary perspective view of a modified tilt frame and heater arrangement illustrating pivotal structure for connecting the heater to the tilt frame along a pivotal axis extending in transverse relation to the axis for pivoting the tilt frame relative to the base.

FIG. 9 is a fragmentary view in cross section taken along line VIII—VIII of FIG. 8.

DESCRIPTION OF PREFERRED EMBODIMENTS

In the embodiment shown in FIGS. 1 to 4, 6 and 7, and dolly-type heating device 5 comprises in combination a heater 6 and a dolly 7. The heater comprises a housing 8, a reflector 9 and an electrode terminal box 11. Main elements of the dolly 7 are a base 14 and a tilt frame 15. The base 14 comprises parallel beams 17 and 18, a cross beam 19 connecting intermediate portions of the parallel beams, a shaft 20 mounting coaxial floor-engaging dolly wheels 21 and 22, and a mast 23. The shaft 20 is centered along the tilting axis N—N for the device 5 as a whole. The bars 17, 18 terminate at the ends opposite the wheels 21, 22 in floor-engaging down-turned pads or elements 24, 25 respectively. Such floor-engaging means of the device are arranged to locate the center of gravity of the device in intermediately overhead relationship .

In the form of the invention illustrated, the tilt frame comprises an elongate main member 26 extending lonitudinally approximately in a plane containing the mast 23 to which it is pivotally connected by a pivot joint 27 at axis M—M. The tilting axis M—M preferable extends in a direction parallel to axis N—N. As shown, the tilt frame is pivoted on the upper end portion of the mast approximately midway along the tilt frame length and terminates in end brackets 28, 29 rigidly attached to opposite ends of the main member 26.

The tilt frame further comprises the dual purpose handle strut 31 which is fixedly attached to that portion of the main member which can be rotated in longitudinally outwardly projecting relation with the upper or distal end of the mast 23. As shown, the handle strut 31 is aligned in a general plane perpendicular to axis M—M and containing the mast 23 and main tilting frame member 26. The handle strut 31 extends from its juncture with the main member at a divergent angle of, e.g., 30 to 45 degrees therewith, in a direction away from the heater 6 and away from the axis M—M approximately to or beyond a plane S—S (see FIG. 1). Plane S—S is parallel to axes N—N and M—M and extends through the more adjacent longitudinal extremity of the heater reflector 9 approximately perpendicularly to the plane 33 of the face of the heater. This geometric arrangement permits the use of the handle strut without engagement of any portion of the heater with a floor as shown in FIG. 3

Exemplary of structure for connecting the base or main mast with the tilt frame 15 is that shown in FIG. 6. A tubular bearing 35 is embedded as by welding within the end of the mast 23. A clamp screw 36 having a wing nut 37 extends through the mast with its axis parallel to that of the bearing 35 at a selected radius from the bearing, such as five to ten inches. Tie-means, such as a shaft element 38, welded to the main member 26 has a portion 39 rotatably received in the bearing 35 and secured therein by means, such as a cotter key 41 and washer 42.

Changes in angular positioning of the tilt frame relative to the base 14 about the first axis M—M is accomplished by quick-release adjustable detent means comprising the aforementioned clamp screw 36 and a slotted lever 45 pivoted on the main member at a radius from axis M—M similar to or suitably related to the aforenamed radius of the clamp screw from the axis M—M to enable efficient relative movement of the tilting frame and the mast. The lever 45 has slot 46 through which the screw 36 extends and a face surface 47 engaged by the nut 37 in the tightened condition of the detent means. The lever also has a shaft portion 48 extending at right angles to the length of the lever through a cylindrical bearing 49 fixed within and transversely through the main member 26 along an axis p—p parallel to axis M—M. Shaft portions 39 and 48 are preferably closely diametrically fitted to respective bearings 35 and 49 to eliminate looseness and wobble of the tilt frame relative to the dolly base. Axial movement within the bearing 49 of the lever 45 is limited by the washer 51 and cotter key 52 shown in FIG. 6 attached to portion 48.

FIGS. 8 and 9 depict a modification directed primarily to structure enabling the heater to be pivoted with respect to the tilting frame along an axis R—R which extends in parallel relation with the elongate direction of the heater. Parts in this modified device similar to those of the device of FIGS. 1 to 4, 6 and 7 are indicated by numerals ending in "a ". Exemplary of a mode for effecting such relative adjustment of the heater and tilting frame is structure comprising a tilting frame main member **26*a*, and end plate 28*a* of which two are fixed to opposite ends of the main member, and a swivel bracket 55 fixed to the heater housing 8 and pivoted on the end plate 28*a* by a bolt 56. Fixing of position in the changing from one angular position of the heater relative to the tilting frame to another is obtained in the use of an elongate lever 58 comprising a shaft portion 59 in journal-bearing relation with the swivel bracket 55 at a selected radius from axis R—R, and a clamp screw 61 anchored in the end plate 28*a*. Similarly, as described above with respect to lever 45 and clamp 36, the lever 58 has an elongate slot 63 through which extends the screw 61. Fixing and releasing of position is obtained through tightening and loosening a wing nut 64. A position of the heater shown in dot-dash line 65 is illustrated at approximately 90 degrees with respect to the full line position shown in FIG. 8**.

Employment of heater-tilting structure such as illustrated in FIGS. 8 and 9 results in shifts of gravity of the device giving rise to the possibility of capsizing. To overcome any such tendency, lateral support of the device may be increased by the provision of means, such as the adjustable lateral elongate legs or braces 71 and 72 shown. The braces 71, 72 are adjustable to positions outside a periphery of the base defined by straight lines extending progressively from one floor-engaging means to the next. In the mode illustrated, the cross beam 19 is tubular, thereby providing an internal passageway of uniform cross section for receiving straight shank portions of the braces 71, 72 in telescoping relationship. The braces may be ordinarily stored in retracted position within the cross member 19. They are secured in laterally extended position by set screws 73, 74 screwed within threaded bosses 75, 76, respectively, of the cross member 19 into engagement with the shanks of braces 71, 72. Each brace has a downturned pad portion 77, 78 for engaging the floor. This arrangement is merely illustrative of many other constructions for obtaining guide relation and securement of lateral braces with respect to the dolly base.

What is claimed is:

1. A dolly-type heating device comprising:

a heater having an elongate housing comprising end walls and side walls, and heat-radiating means supported within the housing substantially along its entire length, said side walls defining an elongate side opening opposite a closed side through which radiant energy may pass from said housing;

a dolly comprising a base having at least three spaced floor-engaging means of which two are means defining a tilting axis for the device in generally parallel proximity with a plane of engagement with a floor; a mast member having a lower end fixed to said base and extending upwardly to a point centrally overhead said floor-engaging means, the upper portion of which comprises pivot joint means;

a tilt frame comprising a main member having pivot joint means and means for connecting the tilt frame to said heater housing; and tie means for pivotally connecting said pivot joint means; said pivot joint means and said tie means being aligned along a pivot axis parallel to said plane;

quick-release detent means connected with the mast member and the tilt frame for releasing the detent means from a normally tightened condition to enable changes in relative angular position of the mast member and the tilt frame about said pivot axis;

said tilt frame comprising a handle strut connected to said main member and extending at an angle divergently therefrom in a direction away from said pivot axis and away from said housing approximately to a plane extending through the more adjacent longitudinal extremity of the heater approximately perpendicularly to the plane of the face of the heater.

2. The device of claim 1 comprising:

rolling means as said two floor-engaging means defining said tilting axis; said base having as other floor-engaging means, a pair of elements spaced from said tilting axis to locate the center of gravity of said housing intermediately overhead all of said floor-engaging means in relatively horizontal position.

3. The device of claim 1 wherein:

the main member of the tilt frame is elongate and its length is substantially coextensive with the length of said housing, said pivot joint means it approximately centered along the length of said main member, and said handle strut member attaches to a portion of the main member extending longitudinally beyond the said mast member;

and the device is attached to the mast member and the tilt frame for fixing the position of the tilt frame at various positions of rotation relative to the mast member about said pivot axis.

4. The device of claim 3 wherein:

said detent means comprises a lever having an elongate guide surface, pivot means connecting one end portion of the lever to one of said main and mast members, releasable clamp screw means slidably encompassing said guide surface attached to the other of said members, said detent means and pivot means being radially spaced from said pivot axis of said members to enable positioning of one member at a desired angle relative to the other.

5. The device of claim 3 wherein:

said detent means comprises a lever having an elongate slot and an integral shaft portion at one end of the slot, said shaft portion received pivotally through an aperture in one of either of the mast member or said elongate main member, and a clamp bolt extending through said slot and affixed to the remaining one of said members, said aperture and said clamp bolt being received by its respective associated member being spaced at selected radii from said pivot axis of the mast and the main members to enable relative rotation of the members through a selected angle.

6. The device of claim 3 wherein:

said tilt frame comprises a pair of pivot plates secured to opposite ends of said main members for rotation about a tilt frame and heater swivel axis extending lengthwise of the main member;

said housing comprises opposite end walls each extending in a direction crosswise of the length of the main member into registry with one of said pivot plates;

fastening means for securing each of the end walls to said pivot plates;

releasable and adjustable detent means connected with and acting between at least one of said pivot plates and said main member for securing the heater in various angular positions relative to said tilt frame.

7. The device of claim 6 wherein:

said tilt frame comprises end plates fixed to the ends of said main member axially inwardly adjacent to said pivot plates;

said detent means comprises an elongate lever pivotally secured to one of said end walls at a selected radius from said swivel axis, said lever having an elongate slot of sufficient length to extend to a portion of the adjacent one of said end plates at all positions in a desired range of rotation of the heater relative to the main member; and clamp bolt means extending through said end plate and said slot.

8. The device of claim 1 wherein:

said means for connecting the tilt frame to said housing comprises pivot joint means defining a swivel axis parallel to the length of the housing enabling said heater to rotate relative to the tilt frame about said swivel axis.

9. The device of claim 8 comprising:

guide means on said base extending transversely thereof;

lateral support means for said device in guide relation with said guide means adjustable therealong to a floor-engaging position outside a periphery of the base extending in straight lines progressively from one of said floor-engaging means to the next.

10. The device of claim 9 wherein:

said guide means on said base comprises a rectilinear cross beam in generally parallel relation with said tilting axis and the lateral support means comprises rectilinear leg means in slidable lengthwise guide relation with said crossbeam.

* * * * *